US005733166A

United States Patent [19]

Hoag

[11] Patent Number: 5,733,166

[45] **Date of Patent: *Mar. 31, 1998**

[54] STORY BOARD WITH ATTACHABLE ELEMENTS

[76] Inventor: Barbara J. Hoag, 1347 Valley Home Rd., Dandridge, Tenn. 37725

[ * ] Notice: The term of this patent shall not extend beyond the expiration date of Pat. No. 5,540,609.

[21] Appl. No.: 668,420

[22] Filed: Jun. 17, 1996

Related U.S. Application Data

[63] Continuation-in-part of Ser. No. 440,747, May 15, 1995, Pat. No. 5,540,609.

[51] Int. Cl.[6] ..... A63H 33/04; A63H 33/00; A63H 3/02

[52] U.S. Cl. ..... 446/75; 446/26; 446/367; 446/901; 40/735

[58] Field of Search ..... 446/26, 27, 28, 446/73, 74, 75, 369, 901, 478, 268; 40/729, 735; 273/DIG. 30

[56] References Cited

U.S. PATENT DOCUMENTS

| | | | |
|---|---|---|---|
| 291,921 | 1/1884 | McArthur | 40/735 X |
| 2,440,062 | 4/1948 | Allen | 40/735 |
| 3,316,669 | 5/1967 | Nachbar | 273/DIG. 30 X |
| 3,436,075 | 4/1969 | Robinson | 446/26 X |
| 4,435,915 | 3/1984 | Zaruba et al. . | |
| 4,543,278 | 9/1985 | Ackerman . | |
| 4,795,716 | 1/1989 | George et al. | 40/735 |
| 4,820,164 | 4/1989 | Kemper | 273/DIG. 30 X |
| 4,853,994 | 8/1989 | Ekstein . | |
| 4,874,340 | 10/1989 | Smallwood . | |
| 4,979,921 | 12/1990 | Cardillo . | |
| 4,993,987 | 2/1991 | Hull et al. . | |
| 5,009,626 | 4/1991 | Katz . | |
| 5,096,752 | 3/1992 | Wagner | 40/735 X |
| 5,118,318 | 6/1992 | Lorizio . | |
| 5,136,726 | 8/1992 | Kellin et al. . | |
| 5,210,881 | 5/1993 | Stocker, Jr. et al. | 446/28 X |
| 5,299,968 | 4/1994 | Bennett . | |
| 5,332,093 | 7/1994 | Littlepage . | |
| 5,340,348 | 8/1994 | Schroeder . | |
| 5,344,356 | 9/1994 | Pizzelli et al. . | |
| 5,394,565 | 3/1995 | Stewart et al. | 446/28 X |
| 5,525,088 | 6/1996 | Mayne | 446/75 |

*Primary Examiner*—Robert A. Hafer
*Assistant Examiner*—D. Neal Muir
*Attorney, Agent, or Firm*—Pitts & Brittian, P.C.

[57] ABSTRACT

A story board with attachable elements (10) for being secured to a wall, with the associated set of dolls (26) being individually and releasably secured thereto. A plurality of loop members (14) are provided along the top border to enable the securement of the story board (12) to a wall. The front panel (15) of the story board (12) is sectioned into a grid of individual panels (16). Each panel (16) illustrates a particular scene, in similar fashion to a conventional story board. Each of the individual panels (16) is decorated to reflect the personality of the particular doll (26) to be secured to that panel (16) and is provided with a conventional fastener (18) for the securement of the doll (26). A pocket (17) is carried by selected of the individual panels (16) for storing various selected items. One individual panel (16) may be provided with a pocket (20) for carrying a story book (24) illustrating at least one story involving the characters of the dolls (26) carried on the individual panels (16). Other individual panels (16) may be provided as decorative panels. The cooperating fastener (32) is secured to the back of the doll (26). A wristband (38) is provided for the securement of one of the dolls (26) to a person's wrist or ankle. A doll carrying device (39) may be used to carry a doll (26), the doll carrying device (39) being carried by the wristband (38).

11 Claims, 9 Drawing Sheets

STORY BOARD WITH ATTACHABLE ELEMENTS

This application is a continuation in part and discloses and claims subject matter disclosed in my earlier filed application Ser. No. 08/440,747, filed on May 15, 1995, now U.S. Pat. No. 5,540,609.

TECHNICAL FIELD

This invention relates to the field of toys and amusement devices, and a method for manufacturing the same. Specifically, this invention relates to a story board with attachable elements.

BACKGROUND ART

In the field of toys and amusement devices, it is well known that dolls of various kinds have been made in the image of humans and animals for centuries. It is known that in ancient history, dolls were carved from stone and wood. More recently, dolls have been made from anything from corn husks, plastics, rags, or other available materials. Dolls have been made and used as personifications of humans and animals especially for children to play with in their developmental stages of life. It is a goal of the toy industry to create dolls which provide long-term amusement potential by providing various settings in which the dolls may be used.

It is well known that children play with dolls with many different media. Further, dolls are provided with many different means for storing and carrying the same. Typical of the art are those dolls and carrying devices disclosed in the following U.S. Patents:

| U.S. Pat. No. | Inventor(s) | Issue Date |
|---|---|---|
| 4,435,915 | J. V. Zaruba, et al. | Mar. 13, 1984 |
| 4,543,278 | G. K. Ackerman | Sept. 24, 1985 |
| 4,853,994 | P. S. Ekstein | Aug. 8, 1989 |
| 4,874,340 | A. R. Smallwood | Oct. 17, 1989 |
| 4,979,921 | J. D. Cardillo | Dec. 25, 1990 |
| 4,993,987 | H. L. Hull, et al. | Feb. 19, 1991 |
| 5,009,626 | M. M. Katz | Apr. 23, 1991 |
| 5,118,318 | R. J. Lorizio | June 2, 1992 |
| 5,136,726 | E. Kellin, et al. | Aug. 11, 1992 |
| 5,299,968 | L. K. Bennett | Apr. 5, 1994 |
| 5,332,093 | F. Littlepage | July 26, 1994 |
| 5,340,348 | E. J. Schroeder | Aug. 23, 1994 |
| 5,344,356 | D. A. Pizzelli, et al. | Sept. 6, 1994 |

Of these, Ackerman ('278) discloses a wall-mounted board for removably storing children's toys using conventional hook-and-loop fasteners. One portion of the hook-and-loop fastener is secured to any toy to be stored thereon. The board serves no other function than to hold the toys. It is not necessarily used as a theme for the toys, or as a medium for playing with the toys. Similarly, Zaruba, et al. ('915), disclose a hanging doll house structure for storing and displaying dolls, stuffed animals, and the like.

Ekstein ('994) discloses a pillow book having pockets provided on individual "pages" of the book. The pockets are provided for receiving character dolls used in telling the story portrayed in the pillow book. Only the portion of the story book that is opened may be used at any given time, as the remainder is closed within the book.

Smallwood ('340) provides a device similar to that disclosed by Ekstein ('994) with the exception that a stuffed toy is permanently affixed to the exterior of the story book.

Clothing is removably secured to the toy and is placed within a pocket on the inside of the book when not secured to the toy.

Lorizio ('318) discloses a pillow cover which includes a pictorial representation of a character and provides storage for dolls in the form of pockets secured to the pillow cover via conventional hook-and-loop fasteners or snaps. Suction cups are carried by each doll for securement to a flat, smooth surface. The pillow cover serves both as a carrier for the dolls and as a medium for playing with the dolls. The background illustrated on the pillow cover is appropriately chosen to coordinate with the particular toys secured thereto. However, when used for its intended purpose of supporting a child's head while sleeping, the toys must be typically be removed from the pillow cover in order to reduce safety hazards or otherwise to aid in the comfort of the sleeping child.

Kellin, et al. ('726), disclose a means for securing decorative elements to various articles of clothing. Specifically, Kellin, et a., teach the use of hook-and-loop fasteners for securing decorative items to caps, belts, suspenders, backpacks, and the like. The decorative items which are subject to the '726 disclosure are costume jewelry such as simulated jewels and other similar items. Kellin, et al., do not disclose the attachment of dolls to people or to storage, display, or interactive devices.

Littlepage ('093) discloses a doll and storage container. The storage container may also be used as a carrying device. The storage container is provided with a plurality of pockets for carrying doll accessories and a hook-and-loop strap for securing the doll. The storage container is closed using hook-and-loop fasteners. The storage container is configured to simulate a mail receptacle, but is not otherwise used in playing with the doll.

Schroeder ('348) discloses a doll having a hook-and-loop fastener for releasably securing an object thereto. For example, an appropriately-sized toy basketball is releasably secured to the hand of a toy basketball player. The toy is stored in a box which is not provided for interactive play with the doll itself. Similarly, Bennett ('968) discloses a doll having secondary toys attachable thereto by means of a hook-and-loop fastener, a hook secured to a necklace, or a "C" clip configured to engage a limb of the doll.

The device disclosed by Pizzelli, et al. ('356) is a storage unit having attachable holders. In similar fashion to the Ackerman ('278) device discussed above, the Pizzelli, et al., device is used to secure various items thereto, the items and the device not being necessarily related in theme. The '356 device is provided as an organizational device for storing items such as those associated with a person's hair (hair bows, combs, etc.).

Cardillo ('921) teaches a device for mounting a doll on the shoulder of a child. Specifically, the '921 device incorporates two straps having a first end secured to the doll and having second ends secured to each other. The doll and the straps thus form a loop. With the second ends free, the doll is placed on the shoulder of the child. The second ends of the straps are then secured to each other, thereby securing the doll to the child's shoulder.

Hull, et al. ('987), and Katz ('626) disclose methods for manufacturing dolls to emulate lifelike features. Hull, et al., teach the photographic application of a person's face on a fabric doll. Katz discloses a method for applying a three-dimensional lifelike representation of the head portion of a real life subject to a substrate structure of configuration and size matched to the real life subject. However, neither of these methods presents a device or method for storing or carrying such dolls.

None of the prior art references disclose a device for storing the dolls while also providing a medium of interaction with the dolls and the child. Further, none of the prior art references teaches a device for storing a plurality of dolls in a manner that does not endanger a child while also not requiring storage space other than wall space.

Therefore, it is an object of this invention to provide a means for storing a plurality of dolls.

It is also an object of the present invention to provide such a storage device which may also be used as an interactive tool for playing with the dolls.

Another object of the present invention is to provide a means for carrying the dolls on a child's person when not being used in association with the storage device.

Still another object of the present invention is to provide such a storage device for storing the dolls which is further provided with a means for storing the carrying means provided for carrying the dolls on a child's person.

DISCLOSURE OF THE INVENTION

Other objects and advantages will be accomplished by the present invention provides a story board designed for being secured to a wall, with an associated set of dolls being individually and releasably secured thereto. Moreover, in the preferred embodiment the story board is designed to store wristbands upon which may be secured the dolls for transporting the same.

The story board of the present invention includes a substantially planar member. In one embodiment, the story board is fabricated in a manner similar to a conventional quilt. In other embodiments, the story board is fabricated from other conventional materials including, but not limited to, laminated paper, plastic, cork, and wood. A plurality of loop members is provided along the top border to enable the securement of the story quilt to a wall. For embodiments other that a quilt, the story board is provided with a suitable, conventional securement device for mounting the story board to a wall or other display device. The front side of the story board is sectioned into a grid of individual panels. Each panel illustrates a particular scene, in similar fashion to a conventional story board or series of thumbnail sketches. Each of the individual panels is decorated to reflect either the personality of the particular doll to be secured to that panel or a scene within the story being portrayed, and is provided with a conventional fastener for the securement of a doll or another object related to the theme of the story board. A pocket is also secured to the individual panels for storing various selected items. One individual panel may be provided with a pocket for carrying a story book illustrating at least one story involving the characters of the dolls carried on the individual panels. The pocket may also be used to store other forms of media related to the story, such as a compact disc, a video, or any other related object. Other individual panels may be provided as decorative panels. The cooperating portion of the fastener is secured to the back of the doll.

A wristband is provided for the securement of one of the dolls to a person's wrist or ankle. In one embodiment, the wristband includes at least a length of elastomeric material such as a conventional elastic strip. One portion of a fastener is carried by the proximal end of the top side of the elastic strip while the cooperating portion of the fastener is carried by the distal end of the bottom side of the elastic strip. The cooperating portions are engaged when the elastic strip is placed around a person's wrist or ankle. In one embodiment, a cooperating portion of a fastener is further provided on the top side of the elastic strip to cooperate with the portion of the fastener carried by the doll. In further embodiments, a harness is carried by the wristband for being secured to the doll.

In further embodiments, the wristband is provided with a harness for the securement of a doll or other object thereto. The harness is preferrably integrally formed with the wristband. The integral wristband and harness, otherwise referred to as a doll carrying device, is fabricated from a durable material in order to withstand repeated use. Further, the material of fabrication is soft in order to maintain safety for use by small children. The doll carrying device may be employed by a child to carry a doll, a stuffed animal, or any other device asociated with the story or the theme of the story board. Of course, it will be understood that items not associated with the story board may likewise be carried by the doll carrying device as desired.

BRIEF DESCRIPTION OF THE DRAWINGS

The above mentioned features of the invention will become more clearly understood from the following detailed description of the invention read together with the drawings in which.

BEST MODE FOR CARRYING OUT THE INVENTION

A story board with attachable elements incorporating various features of the present invention is illustrated generally at 10 in the figures. The story board 12 is designed for being secured to a wall, with the associated set of dolls 26 being individually and releasably secured thereto. Moreover, in the preferred embodiment the story board 12 is designed to store wristbands 38 or carrying devices 39 upon which may be secured the dolls 26 for transporting the same.

Figure 1:
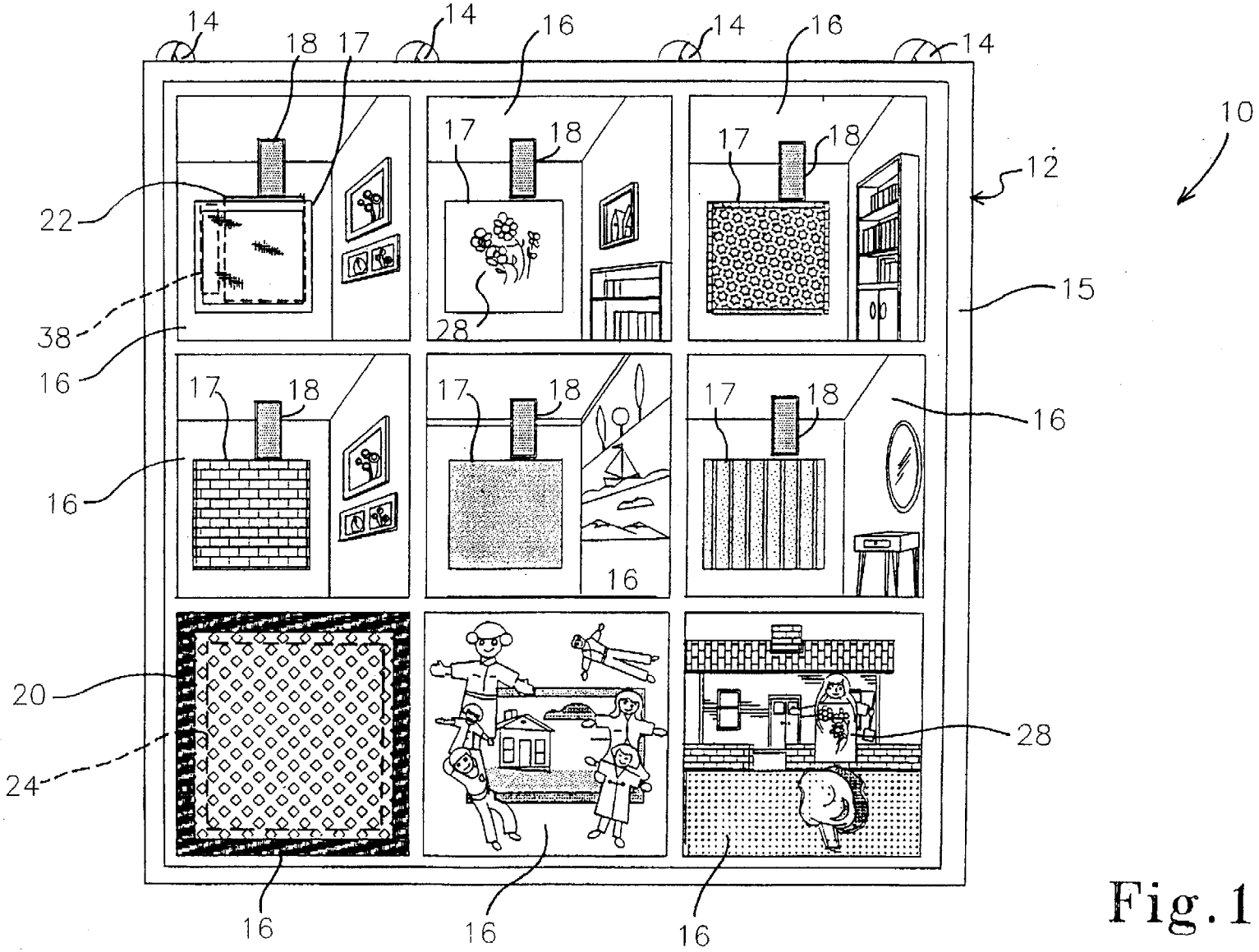
FIG. 1 is a front elevational view of the story board and one of an associated set of dolls being secured thereto, the story board and doll being constructed in accordance with several features of the present invention.
Figure 1A:
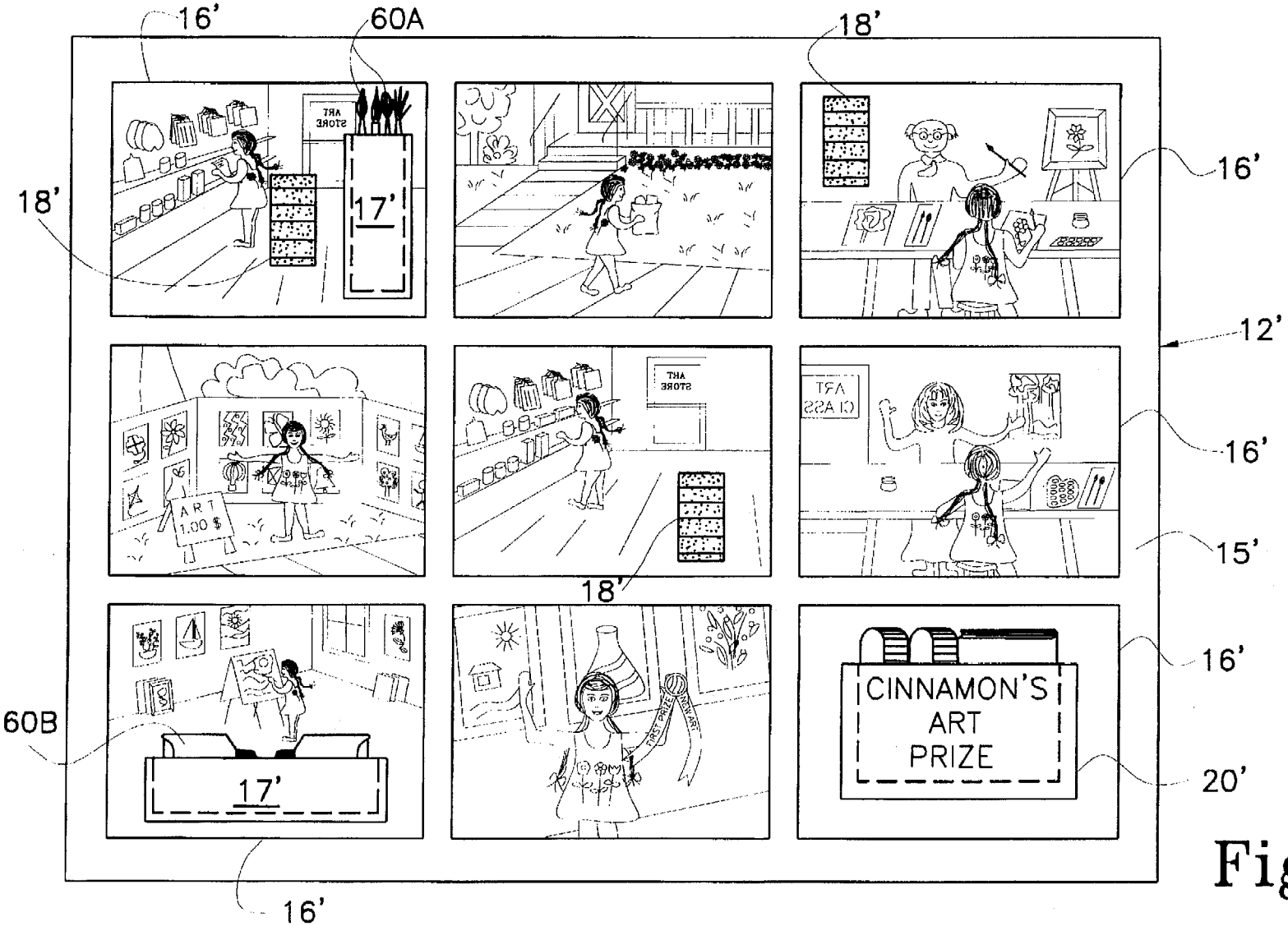
FIG. 1A is a front elevational view of an alternate embodiment of the story board wherein the individual panels illustrate various scenes in a story.

The story board 12 of the present invention includes a planar member fabricated in a conventional manner to include a front surface having a plurality of panels 16. In the illustrated embodiment of FIG. 1, the story board 12 is fabricated in a manner similar to a conventional quilt. A plurality of loop members 14 are provided along the top border to enable the securement of the story board 12 to a wall. The loop members 14, in the preferred embodiment, are spaced equidistantly from each other such that when the story board 12 is hung from a wall, there will be minimal sagging. As illustrated in FIG. 1A, the story board 12 may alternatively be fabricated from wood, plastic, laminated paper, or other conventional materials, with appropriate securement devices (not shown) being provided for hanging the story board 12 on a wall or other support surface. For example, for a more rigid story board 12 such as one fabricated from wood, an easel (not shown) may be used to support the story board 12. This use is of utility especially in a classroom setting for teachers to use as a visual aid in telling a story, with the ability to employ interaction of the children to whom the story is being told, while also allowing the story board 12 to be moved or stored when not in use.

The front panel of the story board 12 is sectioned into a grid of individual panels 16. Each panel 16 illustrates a particular scene, in similar fashion to a conventional story board or series of thumbnail sketches. The embodiment of the front panel 15 illustrated in FIG. 1 is sectioned into a three-by-three grid of such individual panels 16. The top two rows of individual panels 16 each illustrate a particular room in a house, with each individual panel 16 having its own decor. Each of the individual panels 16 is decorated to reflect the personality of the particular doll to be secured to that panel 16. In the embodiment illustrated in FIG. 1A, each individual panel 16' illustrates a scene in a story, with the combination of the individual panels 16' completing a story. To this extent, each individual panel 16 is provided with a conventional fastener 18 for the securement of a doll 26 thereto. In the illustrated embodiment, the fastener 18 is a hook-and-loop fastener, with the loop portion thereof being secured to the individual panel 16 and the cooperating hook portion 32 being secured to the doll 26. Although not shown, the fastener 18 may likewise be a cooperating pair of magnets, with one being secured to the story board individual panel 16 and one being carried by the doll 26 or other object to be secured to the story board. Other conventional fasteners 18 may be used equally as well, including, but not limited to, snaps, buttons, and the like. A pocket 17 is also secured to the individual panels 16 for storing various selected items. For example, printed matter 22 related to the particular doll 26, a wristband 38 or doll carrying device 39 for carrying the doll 26, or other related items may be stored within the pocket 17. The printed matter 22 may include a birth certificate, a biographical sketch of the character portrayed by the doll 26, or any other identification material.

In the illustrated embodiment of FIG. 1, the bottom left individual panel 16 is provided with a pocket 20 for carrying a story book 24. In the embodiment illustrated in FIG. 1A, the bottom right individual panel 16' is provided with a pocket 20'. The story book 24 of the preferred embodiment illustrates at least one story involving the characters of the dolls 26 carried on the individual panels 16 of the top two rows. The remaining two panels 16 are illustrated as being decorative panels 16, with nothing being received therein or secured thereto. For example, in the central panel 16 of the bottom row, a house is illustrated to reflect the house in which the characters of the dolls 26 live, i.e., the house in which the rooms illustrated in the top two rows are found. The last panel 16, in the bottom right corner, illustrates a garden behind the house. It will be understood that, although not shown, the pocket 20 may also be provided for receiving other media associated with the story. For example, a musical compact disk or recording of the story may be provided. Further, a video or interactive game might be provided to reinforce the story.

FIG. 1A illustrates another story board 12' having nine individual panels 16' arranged in a three-by-three grid. Eight of the panels 16' is illustrated with a scene from a story book 24'. As the story is read from the story book 24', a doll 26 or other accessory may be releasably secured to the individual panels 16' as described above. Each panel 16' may be provided with a pocket 17' for receiving props 60 associated with the story portrayed on the story board 12'. For example, in the story potrayed on the story board 12' illustrated, the character is a girl who is an artist. In the top left panel 16', a pocket 17' is provided for receiving a number of paint brushes 60A, while the bottom left panel 16' is configured to receive tubes 60B of paint. Thus, the pockets 17' may be strategically placed such that the child may participate in the story being told and thus enhance her imaginative thinking skills. It will be seen, also, that the story board 12' may be useful in enhancing the imaginative thinking skills of a child in that the illustrated panels 16' combine to tell a story in pictures, while the child may tell the story in her own words using those pictures.

Although nine individual panels 16 are illustrated in a three-by-three grid, with a particular arrangement of individual panels 16, pockets 17, and fasteners 18, it will be understood that more or fewer individual panels 16 may be provided. Further, the individual panels 16 may be disposed in a grid pattern, or in other than a grid pattern. Each individual panel 16 may be independently defined with a fastener 18, a pocket 17, or purely decorative items. It will be understood that each individual panel 16 is defined as a scene in a story such that all of the individual panels 16 combine to initiate a story line involving the particular set of dolls 26 and other articles to be secured thereto. Therefore, it is not intended that the present invention be limited to a story board 12 having nine individual panels 16 in a three-by-three grid.

Figure 2:
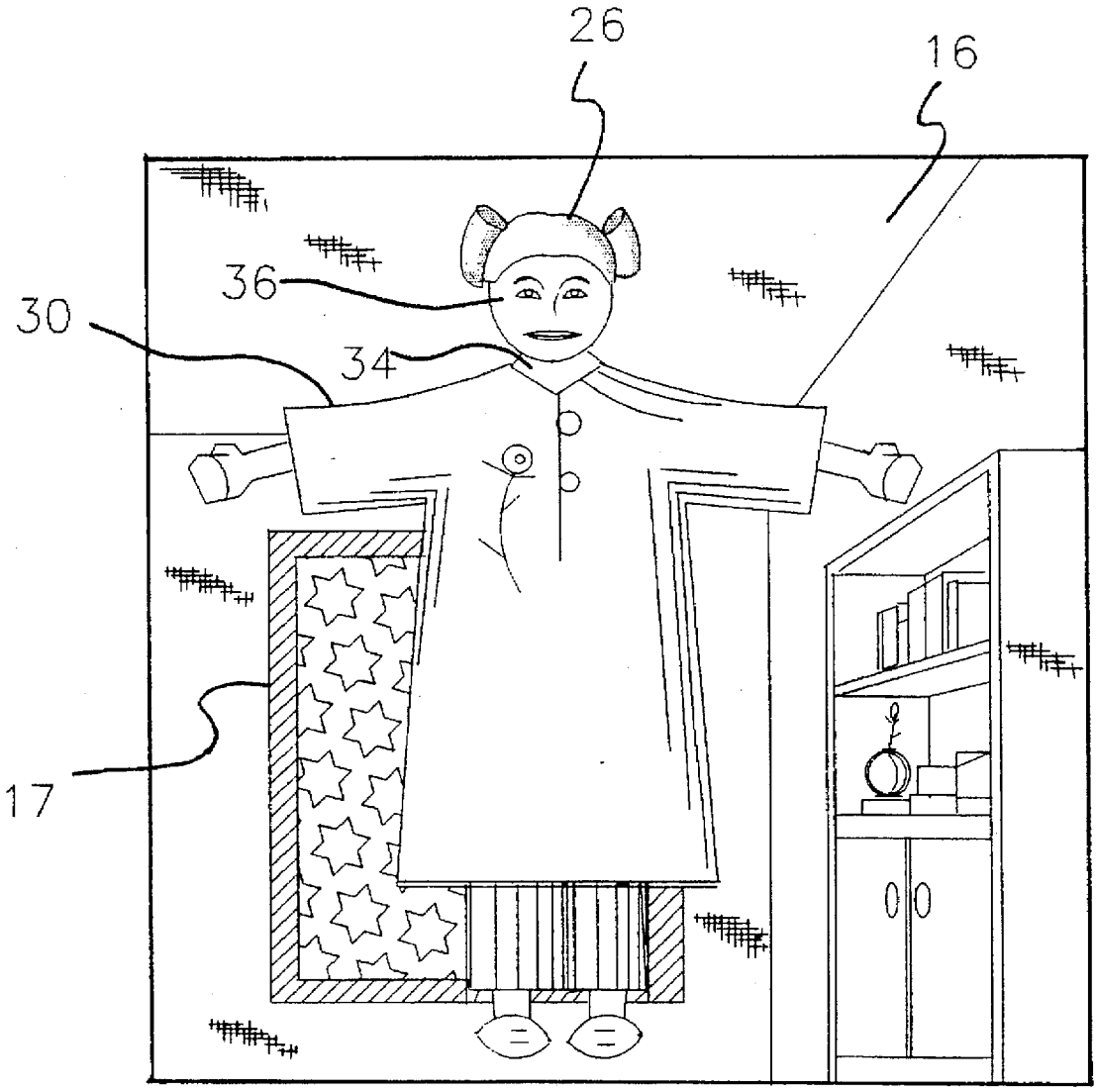
FIG. 2 illustrates a front elevational view of one panel of the story board illustrated in FIG. 1 showing a doll secured thereto.

Illustrated in FIG. 2 is an enlarged view of one of the individual panels 16 shown in FIG. 1. In this figure, a doll 26 is illustrated as being secured to the panel 16. The doll 26 and the individual panel 16 are each constructed to match the personality of the other. For example, the material of construction of the pocket 17 carried within the individual panel 16 may match an article of clothing worn by the doll 26. A decorative design 28 may also be common to the apparel of the doll 26 and something within the room, such as a decorative design 28 displayed on the pocket 17, on a painting on a wall within the room, or as an object found within the room. Particular personalities may include a reader, with bookshelves filled with books being illustrated in the room; a sports fan, with selected sports equipment being illustrated; an artist, with paintings illustrated, or any other personality imaginable.

Figure 4:
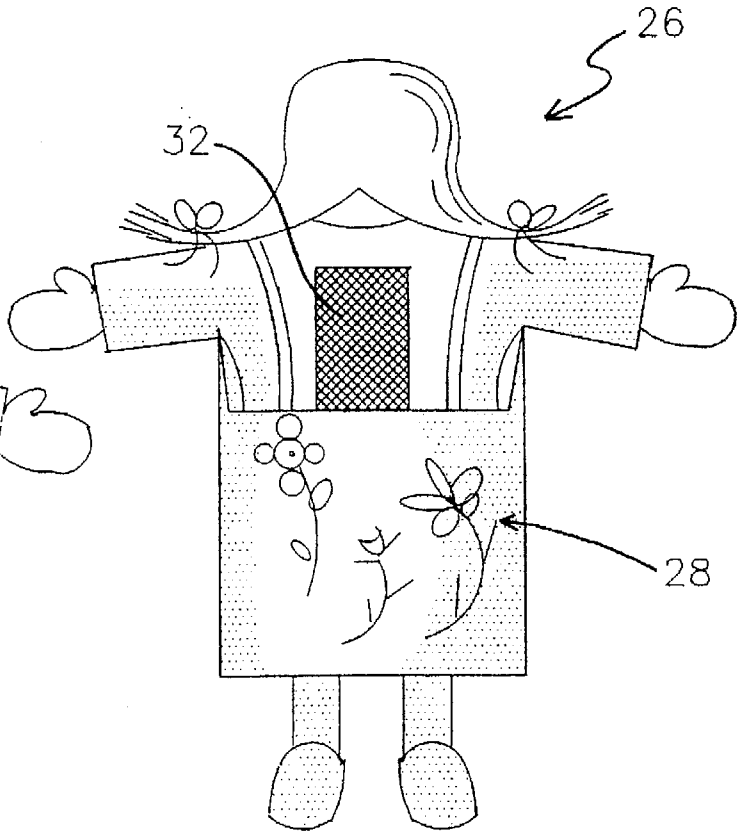
FIG. 4 is a back elevational view of the doll illustrated in FIG. 4.
Figure 3:
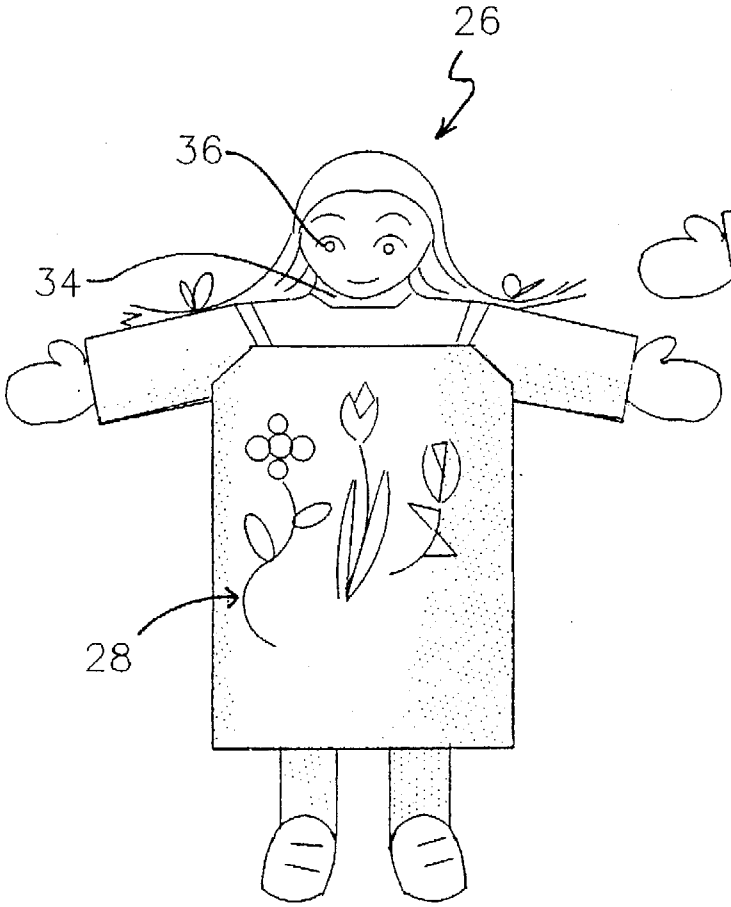
FIG. 3 is a front elevational view of a doll associated with the story board of the present invention.

FIGS. 3 and 4 illustrate the front and back views of a doll 26 which is well-suited for use with the present invention. The decorative design 28 illustrated on this doll's smock 30 is similar to that illustrated on the pocket 17 of the top center panel 16 illustrated in FIG. 1. Therefore, in this embodiment, the doll of FIGS. 3 and 4 is best suited for this panel 16. The personality of this doll 26 is indicative of a plant lover. Notice in the bottom right panel 16 illustrated in FIG. 1 that this doll 26 is shown gardening. As shown in FIG. 4, the cooperating portion 32 of the hook-and-loop fastener 18 is secured to the back of the doll 26.

Figure 5:
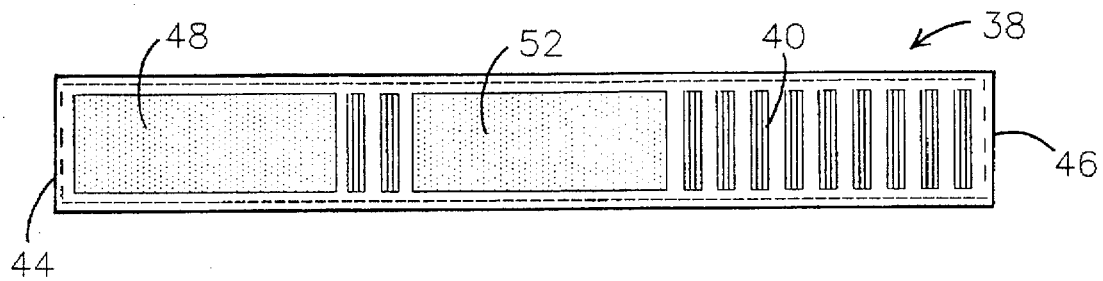
FIG. 5 is a top plan view of a wristband constructed in accordance with several features of the present invention.
Figure 6:
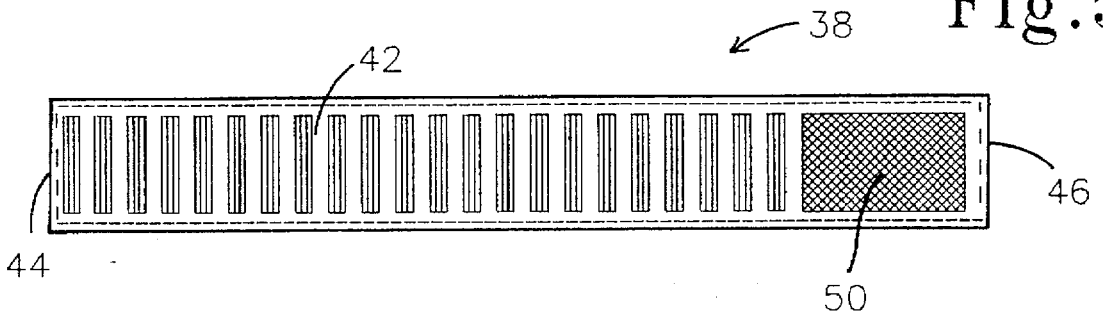
FIG. 6 is a bottom plan view of the wristband of FIG. 5.
Figure 7:
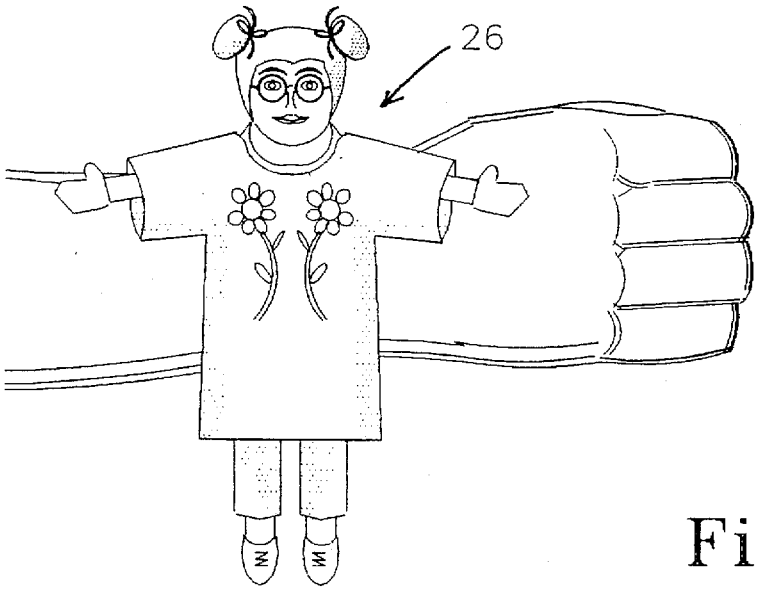
FIG. 7 illustrates the securement of a doll of the present invention being worn by a child using a wristband such as that illustrated in FIGS. 5 and 6.

Illustrated in FIGS. 5 and 6 are the front and back views of a wristband 38 provided for the securement of one of the dolls 26 of the present invention to a person's wrist or ankle. The wristband 38 is comprised of a length of elastomeric material such as a conventional elastic strip. One portion 48 of a hook-and-loop fastener is carried by the proximal end 44 of the top side 40 of the elastic strip while the cooperating portion 50 of the hook-and-loop fastener is carried by the distal end 46 of the bottom side 42 of the elastic strip. The cooperating portions 48,50 are thus engaged when the elastic strip is placed around a person's wrist or ankle. A portion 52 of a hook-and-loop fastener is further provided on the top side 40 of the elastic strip to cooperate with the portion of the fastener 32 carried by the doll 26. In the illustrated embodiment, a loop portion 52 is carried by the elastic strip for this purpose. Thus, it will be seen that the wristband 38 is securable to a child's wrist or ankle such that a doll 26 of the present invention may then be secured thereto and carried thereby. Such a disposal of a doll 26 of the present invention is illustrated in FIG. 7. It will be understood that other wristband 38 constructions may be used as well as the one illustrated and described. Further, it will be understood that a doll 26 of the present invention may be secured to other articles of clothing, such as caps or visors, shirts, pants, shoes, or any other such article. Therefore, the present invention is not intended to be limited to a wristband 38 as illustrated and described, or to the securement of a doll 26 to a wristband 38 in general.

Figures 8, 9, 10:
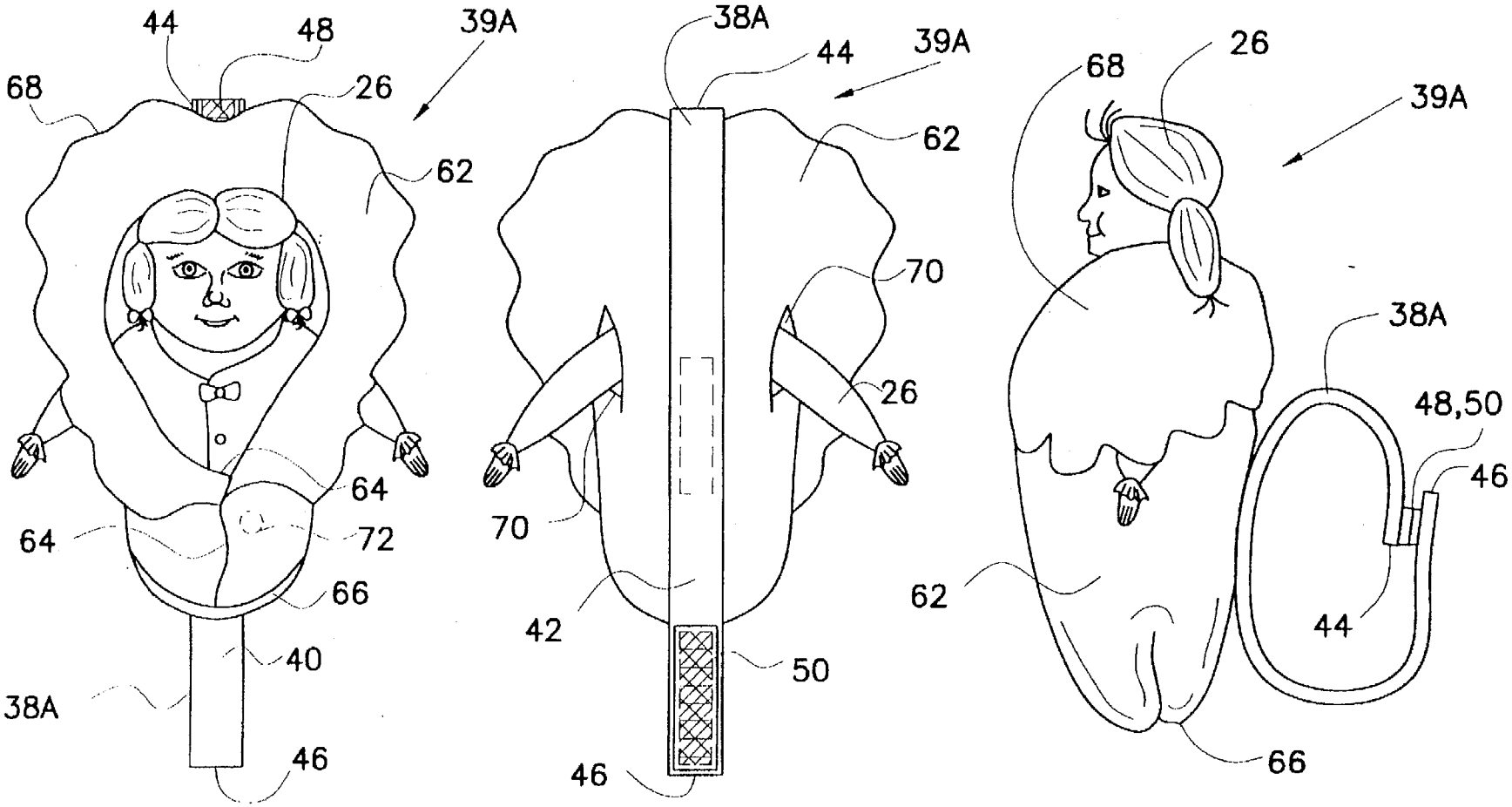
FIGS. 8–10 illustrate front, rear, and side elevation views, respectively, of one embodiment of a doll carrying device used in accordance with the present invention.

FIGS. 8–10 illustrate the front, back and side views of one embodiment of a doll carrying device 39 used in conjunction with the wristband 38 described above. The doll carrying device 39 is provided for further enhancing the creativity of the child playing with the doll 26 or other stuffed animal. To this extent, it will be understood that the doll carrying device 39 may be adapted to carry human-like dolls, or animal-like dolls, with the various characteristics of the doll carrying device 39 being adapted for the particular type of doll 26 being carried. Other objects may also be carried by the doll carrying device 39, as well, with the pouch 62 or harness 74 being appropriately modified. In the embodiment illustrated in FIGS. 8–10, the doll carrying device 39 includes a pouch 62 for enveloping the legs and a portion of the torso and the doll 26. Preferably, the pouch 62 is fabricated from a single piece of suitable material, the ends 64 of which are overlapped to form a pocket, with the bottom edge 66 of the pocket being sewn or otherwise closed. The doll carrying device 39 is fabricated from a durable material in order to withstand repeated use. Further, the material of fabrication is soft in order to maintain safety for use by small children. The ends 64 are secured one to the other using a conventional releasable fastener 72 such as a hook-and-loop fastener, a snap, or a button. The top edge 68 of the pouch may be scalloped or otherwise cut to achieve a particular decorative look. Openings 70 are defined in the pouch 62 for receiving the arms of the doll 26.

A wristband 38A is secured to the pouch 62 by stitching or other conventional methods as illustrated in FIG. 9. Alternatively, it is envisioned that the wristband 38A may be releasably secured to the pouch 62 as with a hook-and-loop fastener (not shown) such that the pouch 62 may be removed for play, and for securement to the story board 12. As in the previously described embodiment of the wristband 38, cooperating portions 48,50 of a hook-and-loop fastener are carried by the proximal end 44 of the top side 40 and the distal end 46 of the bottom side 42 of the wristband 38A, respectively.

Figure 13:
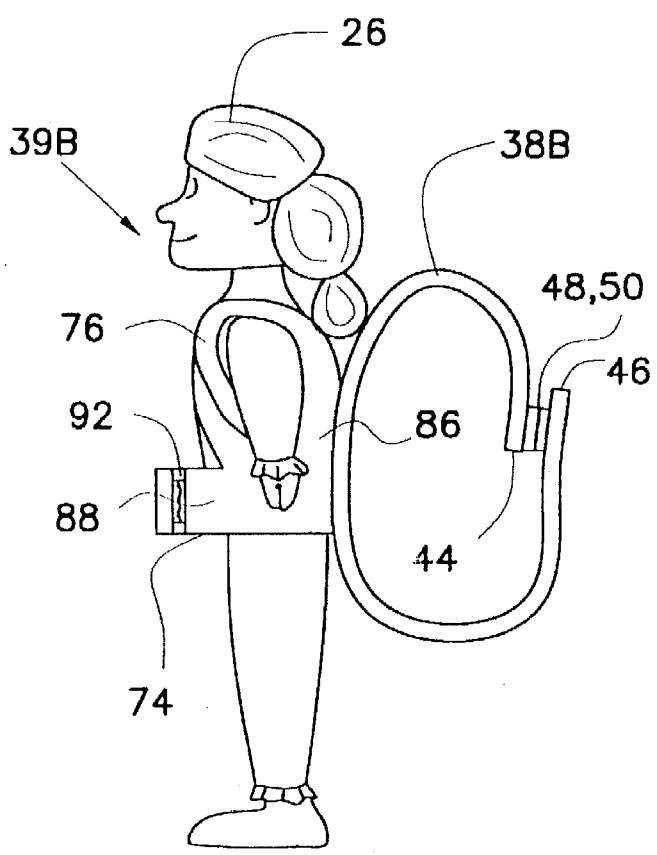
FIGS. 11–13 illustrate front, rear, and side elevation views, respectively, of an alternate embodiment of a doll carrying device used in accordance with the present invention.
Figure 12:
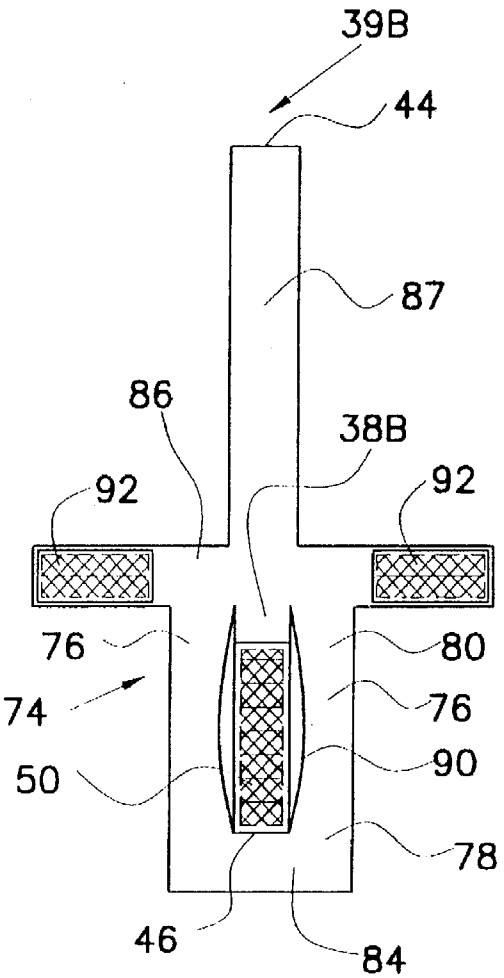
Figure 11:
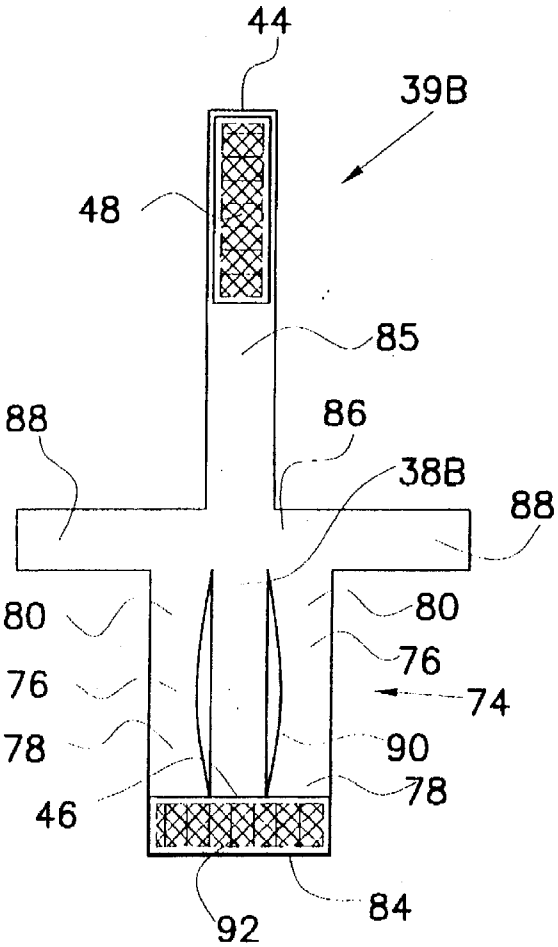
Figure 16:
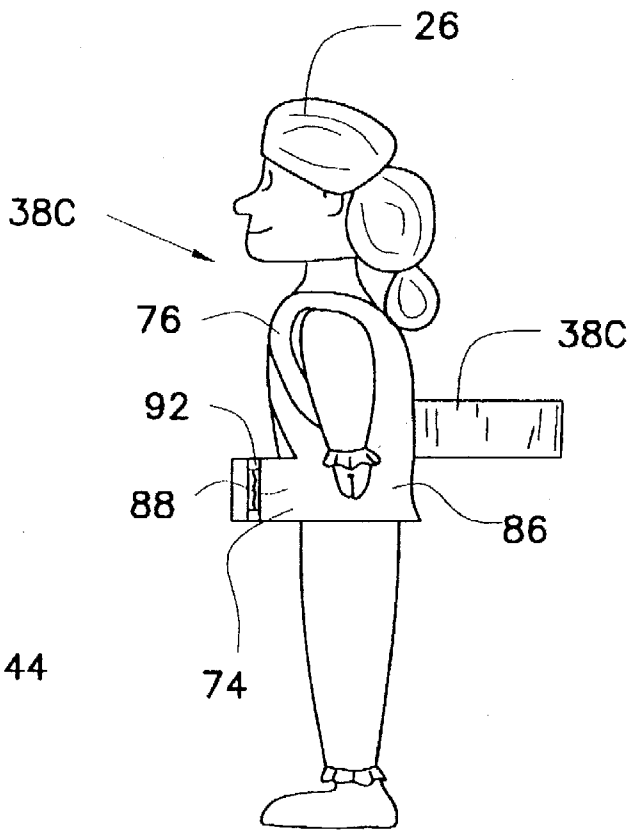
FIGS. 14–16 illustrate front, rear, and side elevation views, respectively, of a further alternate embodiment of a doll carrying device used in accordance with the present invention.
Figure 14:
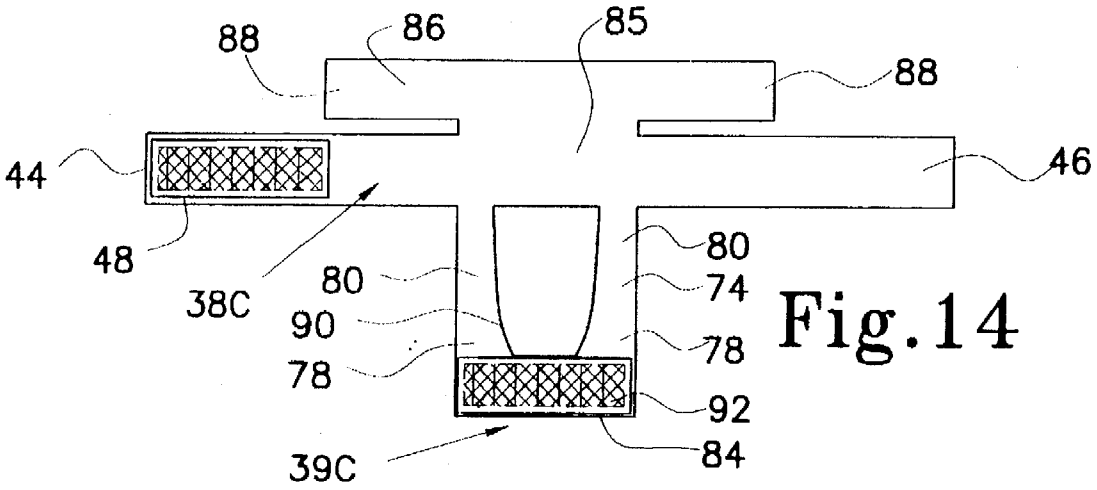
Figure 15:
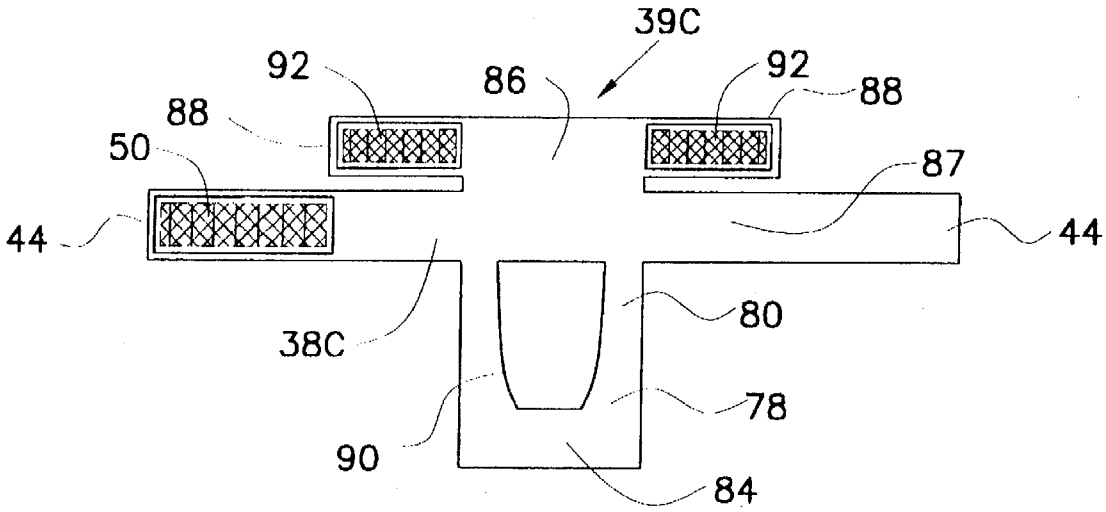

FIGS. 11–13 illustrate an alternate embodiment of the doll carrying device 39 wherein the doll 26 is carried in an orientation substantially perpendicular to the orientation of the arm upon which the doll carrying device 39 is worn. FIGS. 14–16 illustrate a similar embodiment with the exception of the doll being oriented substantially parallel with the arm upon which the doll carrying device 39 is worn. Each of the embodiments illustrated in FIGS. 11–16 is provided with a harness 74 integrally formed with a wristband 38.

The harness 74 includes two shoulder straps 76 for being received over the shoulders of the doll 26 and a belt 82 for being received around the doll 26 proximate the waist. The first ends 78 of the shoulder straps 76 are integrally formed with a first portion 84 of the belt 82, and the second ends 80 of the shoulder straps 76 are integrally formed with a second portion 86 of the belt 82. The second portion 86 of the belt 82 defines an extended portion 88 at each end thereof Thus, the shoulder straps 76 and the first and second portions 84,86 of the belt 82 are configured to define an opening 90. The head of the doll 26 being carried is inserted through the opening 90 such that the first portion 84 of the belt 82 is positioned in the front of the doll 26. The extended portions 88 of the second portion 86 of the belt 82 are then wrapped around the doll 26 to engage with the first portion 84 of the belt 82. To this extent, the top side 85 of the first belt portion 84 and the bottom side 87 of the second belt portion extended members 88 each carry cooperating fasteners 92. As illustrated, one cooperating fastener 92 found to be suitable is a hook-and-loop fastener.

As in the previously described embodiments, the wristband 38B,C carries cooperating portions 48,50 of a hook-and-loop fastener by the proximal end 44 of the top side 40 and the distal end 46 of the bottom side 42 thereof. In the embodiment illustrated in FIGS. 11–13, the wristband 38B and second portion 86 of the belt 82 are oriented at right angles with respect to each other and are integrally formed proximate the middle portions thereof. In the embodiment illustrated in FIGS. 14–16, the wristband 38C is oriented at right angles to the shoulder straps 76 and is integrally formed therewith proximate the middle portion of the wristband 38C and the second ends 80 of the shoulder straps 76.

Figure 17:
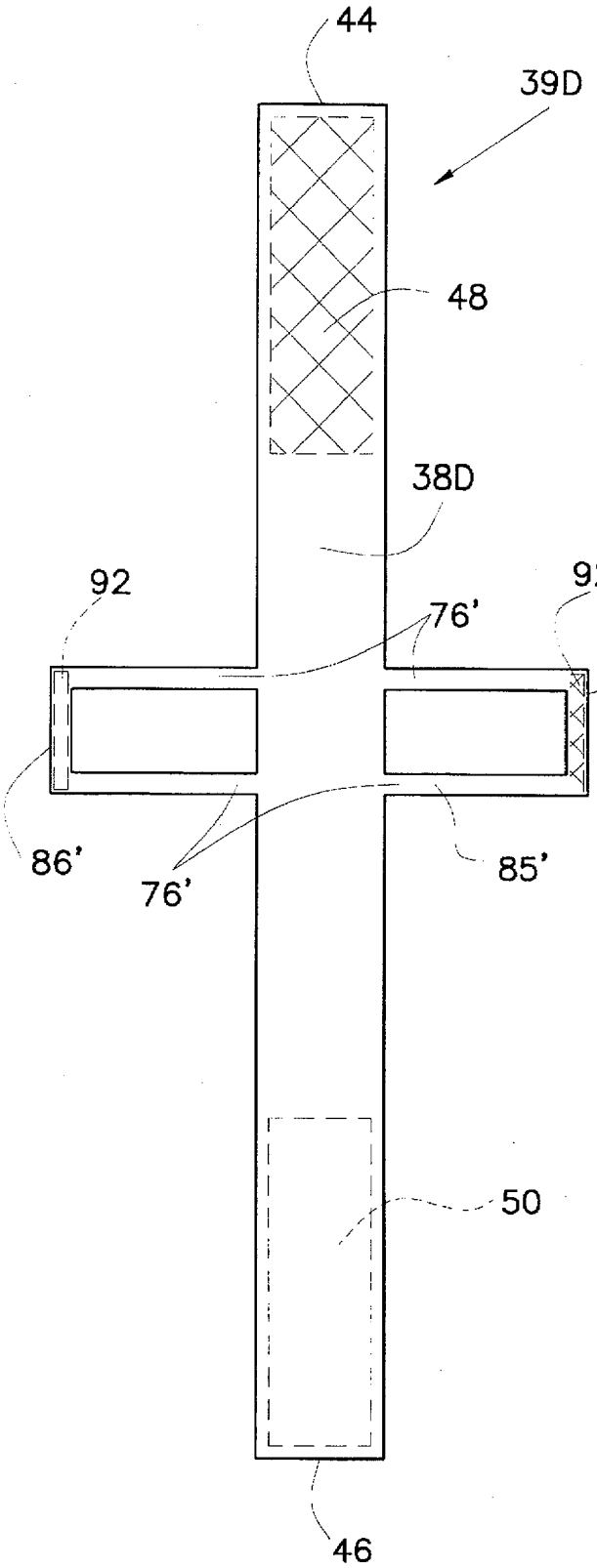
FIG. 17 illustrates a top view of a further alternate embodiment of a doll carrying device used in accordance with the present invention.
Figure 18:
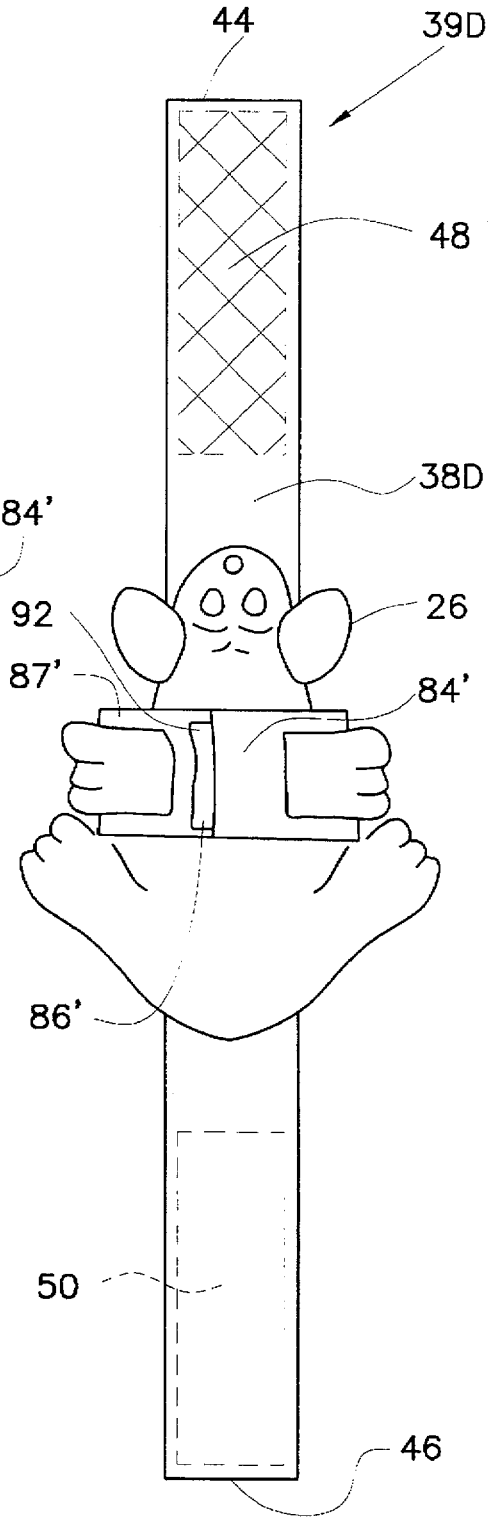
FIG. 18 illustrates the doll carrying device of FIG. 17 with an animal-like doll carried therein.

FIGS. 17 and 18 illustrate a further embodiment of the doll carrying device 39D. In this embodiment, a pair of straps 76' are substantially bisected by the wristband 38D. The first ends 78' are integrally formed with a first securement portion 84', while the second ends 80' are integrally formed with a second securement portion 86'. Cooperating portions of a fastener 92 are carried by the top side 85' of the first securement portion 84' and the bottom side 87' of the second securement portion 86'. As illustrated in FIG. 18, an animal-like doll 26 may be carried by the doll carrying device 39D, as with any of the other embodiments. It will be understood that either of the illustrated doll carrying devices 39A–D and the wristband 38 may each be adapted for carrying other objects (not shown) whether or not related to the particular theme or story of the story board 12.

The story board 12 and associated set of dolls 26 is provided for the entertainment of a child. Further, by associating a set of dolls 26 with a particular story board 12, it is intended that the creativity of the child be enhanced by encouraging the development of the child by providing a setting and a cast of characters. When acting out with the dolls 26, a child may move the dolls 26 from room to room, or may use the dolls 26 to interact with other toys. By providing a book 24 which portrays a story about the particular dolls 26 associated with the story board 12, a characterization of each of the dolls 26 may be initiated, thus causing further development of the child's imagination and creativity. Further, while the story is being read, the dolls 26 may be moved accordingly, or at least played with while they are specifically being discussed.

A further advantage to the story board 12 of the present invention is that it inhibits organizational skills. Specifically, each individual panel 16 is provided for the securement of one doll 26 thereto. Because each individual panel 16 is decorated specifically for one particular doll 26, the child not only has to place all of the dolls 26 on the story board 12, but is encouraged to place the dolls 26 in their appropriate rooms. Therefore, the child is encouraged to maintain the dolls 26 in an orderly fashion and learns that everything has its proper place.

From the foregoing description, it will be recognized by those skilled in the art that a story board and associated set of dolls offering advantages over the prior art has been provided. Specifically, the story board and associated set of dolls is provided for displaying and storing a set of dolls, the story board defining a story board having a plurality of scenes. Each doll is provided a particular scene in which they interact and are ultimately stored. The present invention also provides a means for carrying each individual doll in a manner that makes losing the dolls difficult. Further, the story board of the present invention is provided with a means for storing the carrying devices when not in use. The dolls of the present invention are fabricated from soft materials to create minimal risk to children playing with the story board of the present invention. Further, the dolls of the present invention are fabricated using embroidery techniques provided for achieving human or animal likenesses.

While a preferred embodiment has been shown and described, it will be understood that it is not intended to limit the disclosure, but rather it is intended to cover all modifications and alternate methods falling within the spirit and the scope of the invention as defined in the appended claims.

Having thus described the aforementioned invention, I claim:

1. A story board for being displayed on a wall and for telling a story, said story board comprising:

at least one element attachable to said story board;

a planar member defining a front panel, said front panel defining a plurality of first individual panels and a second individual panel, wherein at least two of said plurality of said first individual panels is graphically illustrated to depict a scene, and wherein each said graphically illustrated first individual panel combines with each other said graphically illustrated first individual panels to illustrate the story;

a plurality of first pockets for storing items associated with said at least one attachable element, each of said plurality of first pockets being secured to one of said plurality of first panels;

a second pocket closely receiving a book conveying the story, said second pocket being secured to said second individual panel;

a plurality of first fasteners, one each being carried by one each of said plurality of first individual panels for securement of one of said at least one attachable element thereto; and a plurality of second fasteners, one each being secured to each of said at least one attachable element for cooperating with said plurality of first fasteners to secure each of said at least one attachable element to said story board.

2. The story board of claim 1 wherein each of said plurality of first fasteners is one portion of a hook-and-loop fastener, and said second fastener is a cooperating portion of said hook-and-loop fastener.

3. The story board of claim 1 further comprising a carrying device configured to be worn on a person, said carrying device being provided for securement thereof to one of said at least one attachable element such that said at least one attachable element may be worn on the person when not attached to said story board.

4. The story board of claim 3 wherein each of said plurality of first fasteners is one portion of a hook-and-loop fastener, and said second fastener is a cooperating portion of said hook-and-loop fastener, and wherein said carrying device includes one of said first fasteners for cooperating with said second fastener secured to each of said at least one attachable element.

5. The story board of claim 1 wherein said planar member is fabricated from a conventional quilted material.

6. The story board of claim 1 wherein said planar member is fabricated from a material selected from the group consisting of at least wood, plastic, metal, and laminated paper.

7. A story board for being displayed on a wall and for telling a story, said story board comprising:

a planar member defining a front panel, said front panel defining a plurality of first individual panels and a second individual panel, wherein at least two of said plurality of said first individual panels is graphically illustrated to depict a scene, and wherein each said graphically illustrated first individual panel combines with each other said graphically illustrated first individual panels to illustrate the story;

a plurality of first pockets for storing items associated with said at least one attachable element, each of said plurality of first pockets being secured to one of said plurality of first panels;

a second pocket for closely receiving a book conveying the story, said second pocket being secured to said second individual panel;

a plurality of first fasteners, one each being carried by one each of said plurality of first individual panels for securement of one of said at least one attachable element thereto;

a plurality of second fasteners, one each being secured to each of said at least one attachable element for cooperating with said plurality of first fasteners to secure each of said at least one attachable element to said story board; and a carrying device configured to be worn on a person, said carrying device being provided for carrying one of said at least one attachable element such that said at least one attachable element may be worn on the person when not attached to said story board, said carrying device including at least a strap worn about one of a person's extremities.

8. The story board of claim 7 wherein said carrying device further includes a pouch carried by said strap, said pouch being configured to closely receive and envelope at least a portion of one said attachable element, said pouch defining a sheet material having first and second ends and top and bottom edges, said first and seconds being overlapped and said bottom edge being closed in a conventional manner, said pouch further including a conventional fastener for securing said first and second ends one to another.

9. A story board for being displayed on a wall and for telling a story, said story board comprising:

a planar member defining a front panel, said front panel defining a plurality of first individual panels and a second individual panel, wherein at least two of said plurality of said first individual panels is graphically illustrated to depict a scene, and wherein each said graphically illustrated first individual panel combines with each other said graphically illustrated first individual panels to illustrate the story;

a plurality of first pockets for storing items associated with said at least one attachable element, each of said plurality of first pockets being secured to one of said plurality of first panels;

a second pocket for closely receiving a book conveying the story, said second pocket being secured to said second individual panel;

a plurality of first fasteners, one each being carried by one each of said plurality of first individual panels for securement of one of said at least one attachable element thereto;

a plurality of second fasteners, one each being secured to each of said at least one attachable element for cooperating with said plurality of first fasteners to secure each of said at least one attachable element to said story board; and a carrying device configured to be worn on a person, said carrying device being provided for carrying one of said at least one attachable element such that said at least one attachable element may be worn on the person when not attached to said story board, said carrying device including a strap worn about one of a person's extremities and a harness carried by said strap, said harness being configured to be releasably secured to one said attachable element, said attachable element being a doll having at least a head, a torso, and at least one pair of limbs.

10. The story board of claim 9 wherein said harness includes a pair of shoulder straps and first and second belt portions, said first belt portion being carried by and terminating at first ends of each of said pair of shoulder straps, and said second belt portion being carried by second ends of each of said pair of shoulder straps, said second belt portion defining an extended portion at each end thereof, said pair of shoulder straps and said first and second belt portions being cooperatively configured to define an opening through which is received said head of the doll, said extended portions of said second belt portion being wrapped around said waist of the doll, said harness further including a fastener carried by said first and second belt portions to releasably secure said second belt portion extended portions to said first belt portion.

11. The story board of claim 9 wherein said harness includes first and second straps disposed in substantially parallel fashion with respect to each other, and in substantially perpendicular fashion to said carrying device strap, said carrying device strap substantially bisecting said first and second harness straps, each of said first and second harness straps terminating at first and second ends, said first ends of said first and second harness straps being integrally formed with a first securement portion, said second ends of said first and second harness straps being integrally formed with a second securement portion, said harness further including a fastener carried by said first and second securement portions to releasably secure said first and second securement portions one to another.

* * * * *